United States Patent [19]

Heminover

[11] 4,231,079

[45] Oct. 28, 1980

[54] ARTICLE OF WEARING APPAREL

[76] Inventor: Stephen R. Heminover, 4032 N. Avers, Chicago, Ill. 60618

[21] Appl. No.: 24,672

[22] Filed: Mar. 28, 1979

[51] Int. Cl.[2] ..... F21L 15/14

[52] U.S. Cl. ..... 362/106; 362/108; 362/183; 362/184; 362/800

[58] Field of Search ..... 362/103, 104, 105, 106, 362/107, 108, 184, 227, 252, 249, 800, 183

[56] References Cited

U.S. PATENT DOCUMENTS

| | | | |
|---|---|---|---|
| 3,127,115 | 3/1964 | Yellott et al. | 362/183 |
| 3,358,137 | 12/1967 | Sinclair et al. | 362/106 |
| 3,737,647 | 6/1973 | Gomi | 362/104 |
| 3,836,759 | 9/1974 | Silverman | 362/103 |
| 3,901,121 | 8/1975 | Kleiner | 362/104 |
| 3,944,803 | 3/1976 | Chao | 362/108 |
| 3,963,917 | 6/1976 | Romano | 362/106 |
| 4,035,630 | 7/1977 | Burke | 362/104 |

*Primary Examiner*—Monroe H. Hayes

*Attorney, Agent, or Firm*—Hill, Van Santen, Steadman, Chiara & Simpson

[57] ABSTRACT

An article of wearing apparel such as a rigid opaque hat or a multi-layer belt has light emitting diodes mounted therein for being viewed, the terminals of the diodes and the circuitry for controlling the same being concealed within the article of apparel or on the person of the wearer. Control circuitry includes an electronic clock which sends electric pulses to an electronic counter, the output of which passes through a decoder which controls which diodes are sequentially illuminated to create an illusion of motion for getting the attention of others or for providing a type of theatrical ornamentation for the user.

8 Claims, 5 Drawing Figures

ARTICLE OF WEARING APPAREL

BACKGROUND OF THE INVENTION

1. Field of the Invention:

This invention relates to an article of wearing apparel, and more specifically to such an article having decorative or ornamental illumination means incorporated therein.

2. Prior Art:

It has been known heretofore to provide an article of wearing apparel such as a shoe, a shirt or a necktie with illumination means embodied therein, such as a plurality of lights. In such prior devices, the lights have either been continuously illuminated during use, or they have been merely turned on or off periodically.

SUMMARY OF THE INVENTION

The present invention is directed to an article of clothing having built-in illumination means which are energized or de-energized by control circuitry embodied therein which cause the illumination means to be sequentially energized at a rate to simulate motion within a series of such illumination elements.

Accordingly, it is an object of the present invention to provide an article of wearing apparel which is provided with attention-attracting illumination means.

A further object of the present invention is to provide such an article having a series of illumination means that are so energized as to simulate the appearance of movement.

Many other advantages, features and additional objects of the present invention will become manifest to those versed in the art upon making reference to the detailed description and the accompanying sheets of drawings in which preferred structural embodiments incorporating the principles of the present invention are shown by way of illustrative example.

ON THE DRAWINGS

AS SHOWN ON THE DRAWINGS

Figure 1:
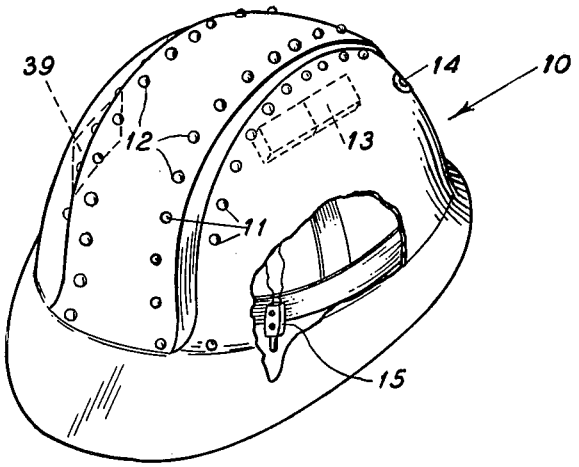
FIG. 1 is a perspective view, partially broken away, of a hat provided according to the present invention.

The principles of the present invention are particularly useful when embodied in an article of wearing apparel such as a hat shown in FIG. 1, generally indicated by the numeral 10. In this embodiment, the hat comprises rigid opaque plastic and has a known configuration including internal structure by which the same is supported on the head of a person. In addition, the hat 10 has an external side that is exposed to view which has several series of perforations 11, and within each of the perforations, there is disposed a light-emitting diode 12. As the perforations are arranged in a selected pattern such as in an arcuate line, each of the series may constitute one of such arcuate lines. The light emitting diodes 12 are the type known in the art as "display type" in that they have a brighter output than certain earlier forms of light emitting diodes. The diodes 12 each have a pair of terminals which project away from the exposed side of the hat 10 and are thus kept out of view and are disposed above the head of the wearer, namely within the hollow cavity of the hat 10.

A rechargeable battery or pair of batteries 13 are secured to the hat within it, there being an electrical jack 14 described below and a control switch 15 also described below. The latter is preferably disposed so that it can be manually actuated without removal of the hat from the wearer's head.

Figure 2:
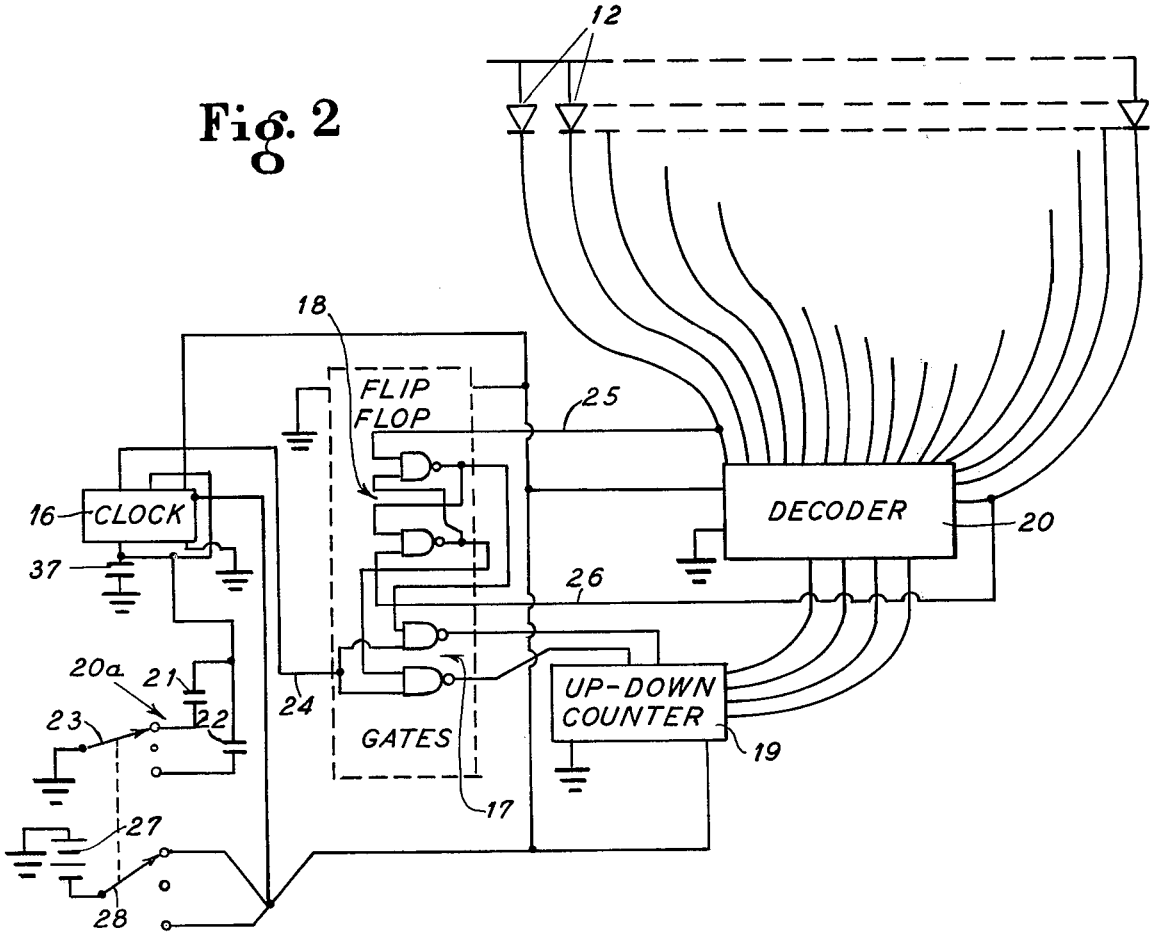
FIG. 2 is a schematic diagram of a circuit that may be embodied in the hat of FIG. 1.

The control circuitry of FIG. 2 interconnects the battery 13 with the terminals of the diodes 12, and the circuitry of FIG. 2 is constructed to energize the diodes sequentially at a rate to optically simulate motion. Such rate is neither specific nor indefinite. Where the rate is too high, the persistence of human vision is such that it creates the illusion that one of the lights or diodes is continuously energized. Where the rate is too slow, the appearance merely is that one of the lights or diodes is energized once in a while. For any one series, a rate as low as four light impulses reaching the human eye in one second will simulate motion, while a rate as high as 32 impulses per second is still not too fast to create an illusion of continuous energization, and thus can be used also to simulate motion.

The control circuitry of FIG. 2 includes an electronic clock 16, a pair of gates 17, a bi-stable flip flop 18, an electronic up-down counter 19, a decoder 20, and a series of the light emitting diodes 12 of the display type. The electronic clock emits electrical pulses at an appropriate rate to provide the simulation of motion or of one light chasing another. Included therewith is a means **20*a* for manually changing the speed of the simulated movement, or the rate of production of clock pulses. In this embodiment, the means 20*a* produces a plurality of fixed speeds. To that end, there is provided a pair of capacitors 21, 22 of unlike size which can be placed in the circuit by a selector switch 23 alternatively. A larger number than two speeds may be provided for. The output of the clock is connected by a line 24 to the input of the gates 17 which are under the control of the flip flop 18, the flip flop 18 enabling one of the gates 17 to be conductive at a time. The gates 17 are connected to the up-down terminals of the counter 19 so that when clock pulses reach the up terminal, counting will take place in an upward direction, and when the flip flop enables the other gate, pulses will reach the down terminal of the counter 19 to provide simulated motion in the other direction. The output of the counter 19 is connected to the decoder 20, and in this embodiment, 16 ouptuts of the decoder extend to 16 diodes 12** for controlling them individually.

The flip flop 18 is under the control of a source of control signals leading to one or the other of a pair of lines 25, 26. In this embodiment, the source of those signals constitutes two of the outputs of the decoder and more specifically, the endmost ones. Thus when the endmost diode 12 is energized, the flip flop is also pulsed to reverse the input of signals to the counter.

A battery 27 is connected to a further multiposition switch 28 whose active terminals are connected together, the switch 28 being ganged to the first-mentioned multiposition switch 23, the switch 28 thus being arranged to energize the control circuitry in all but one of its positions illustrated.

When the circuitry of FIG. 2 is used with a series of 16 diodes, one diode 12 at a time will light up momentarily, after which the next one will light up momentarily, etc. This operation creates the illusion of a spot of light moving along the series to one end and then reversing direction back toward the other end. If the flip flop 18 and the gates 17 were omitted, and only one input were used for the counter 19, the illuminated light would appear to move across or along the length of the series, and on reaching the end would immediately start again at the other end.

The diodes may be placed in various geometric configurations and additional diodes can be powered by the same decoder output as is illustrated in FIG. 2. One example of such circuitry is shown in FIG. 3.

Figure 3:
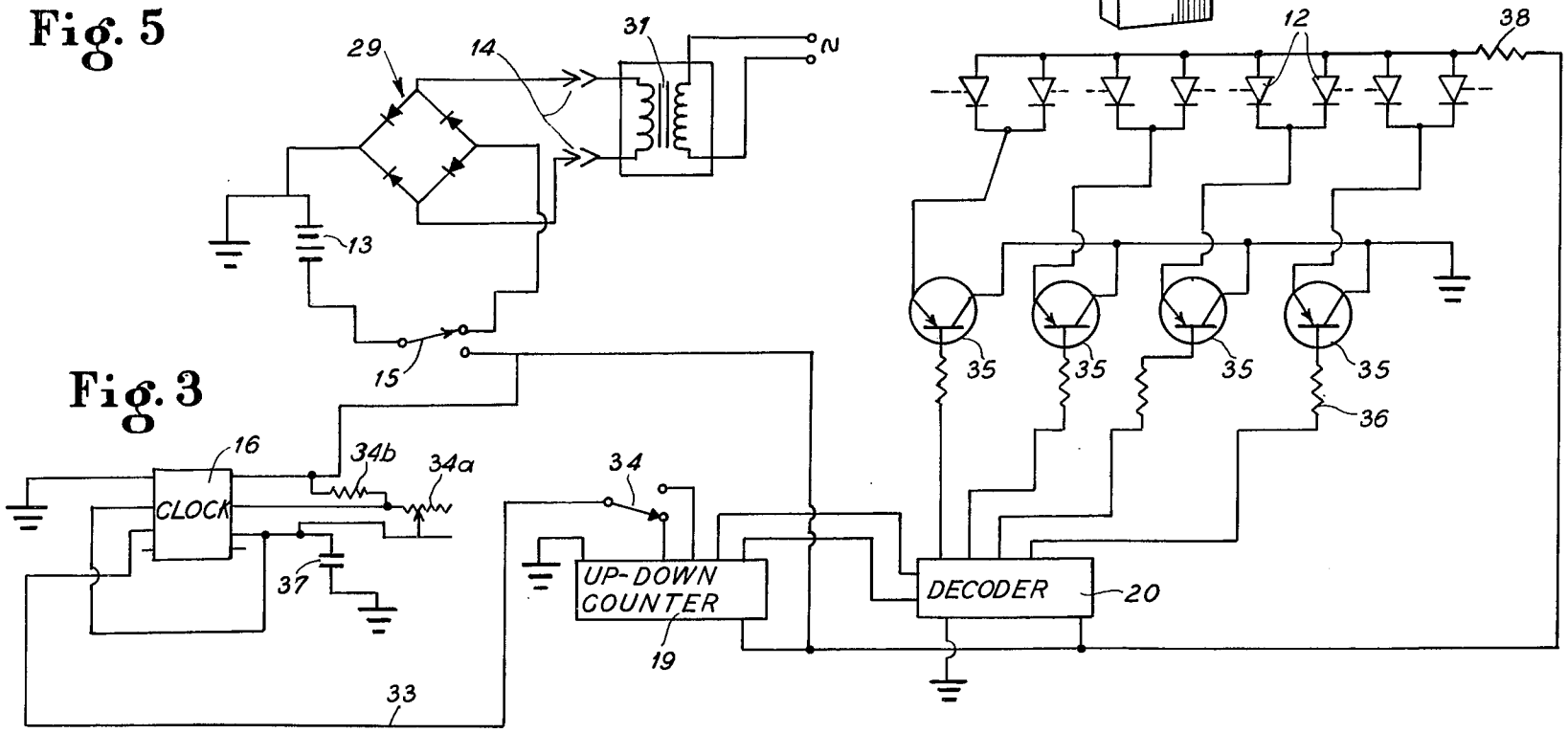
FIG. 3 is a further circuit that may be embodied within the hat of FIG. 1.

The circuitry of FIG. 3 is used with a somewhat larger number of diodes 12, for example 53 diodes arranged in four series which are not equal in length. An example of such an arrangement is shown in FIG. 1. The circuitry of FIG. 3 includes the battery 13, which is rechargeable and to one of its terminals, there is connected a full-wave rectifier bridge 29 which communicates with a jack 14, the jack 14 being adapted to be connected to a low voltage ac-power supply 31 which can be powered by a domestic power supply. The other side of the battery 13 is connected to a single-pole double-throw switch 15 which in the position illustrated closes the bridge circuit while opening the control circuitry, and in the other position, opens the bridge circuitry while closing the control circuitry. The control circuitry includes an electronic clock 16 having an output 33 connected to a further selector switch 34 which enables direction of the clock pulses to either the up-counting terminal or the down-counting terminal of an up-down counter 19, the output of which is conducted to a decoder 20. In this embodiment, four of the outputs of the decoder 20 are utilized, each to control one of the four described series of diodes.

In this embodiment, the means to manually change the speed comprises a variable resistor 34*a* and fixed resistor 34*b* which is readily accessible to the user but disposed within the hat 10. Thus with this circuitry, the speed can be substantially infinitely varied.

As the number of diodes 12 is increased under the control of one of the outputs of the decoder 20, the amount of current that would be handled becomes excessive. Therefore, there is provided for each of the different series, an electronic gate, here comprising a PNP transistor 35 whose base is connected through a resistor 36 to one of the outputs of the decoder 20. Each transistor 35 has a collector that is grounded and the emitters are connected to one of the selected series of diodes.

The diodes 12 controlled by the first transistor 35 would be the first, fifth, ninth, etc. in one row. The second transistor 35 is connected to the second, sixth and tenth diodes of the same rows, etc. In this manner, there is simulated four bright spots at a time in each row chasing each other. In one position of the selector switch 34, the lights appear to chase each other toward the visor of the hat 10, and its other position, the bright spots appear to chase each other toward the rear of the wearer's head.

The principles explained herein can be applied to numerous different patterns and series which are each a matter of taste, design or the like to provide whatever novelty may be desired. Further, features present in the circuitry of FIG. 2 may be embodied in the circuitry of FIG. 3 and vice versa.

The clock 16 may be a National Semiconductor Model NE 555. A capacitor 37 associated therewith has a size of 10 MF. The timing capacitors 21, 22 respectively have a size of 10MF and 20MF. The gates 17 and the flip flop 18 are a unified element, Texas Instrument No. 7400. The counter 19 is a Texas Instrument No. 74193. The decoder 20 is a Texas Instrument 74154. Similar components can also be obtained from National Semiconductor.

The resistors 36 of FIG. 3 are 100 ohms each; a resistor 38 has a resistance of about 25 ohms. The size of this resistor will vary depending upon the number of diodes 12 used in the circuit. If the illumination is not of sufficient intensity, then the size of this resistor 38 must be reduced. The diodes 12 used are available from Chicago Miniature Lamp Works of Chicago, Illinois, and are referred to by them under their designation "Hi-Brite".

The circuitry of either FIG. 2 or FIG. 3 can be unified and mounted on a conventional printed circuit board which in turn is secured as shown at 39 in FIG. 1 within the hat.

Figure 4:
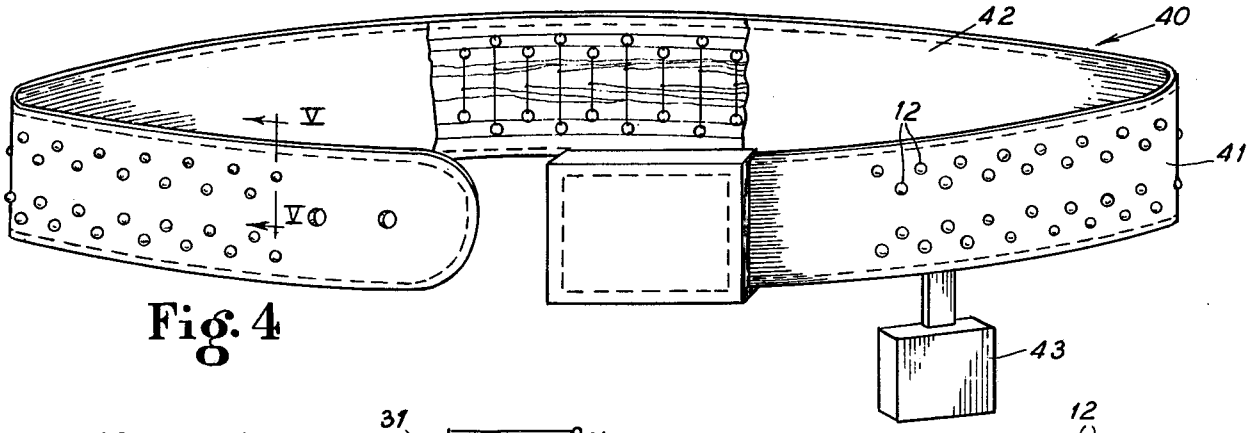
FIG. 4 is a perspective view, partially broken away, of a belt embodying the present invention.
Figure 5:
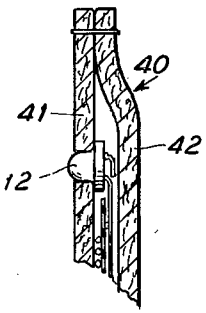
FIG. 5 is an enlarged fragmentary cross-sectional view, partly broken away, taken along line V—V of FIG. 4.

The article of wearing apparel may constitute other forms than a hat, and illustrating this fact is FIG. 4 showing a multi-layer belt generally indicated at 40. The outer layer of the belt 40 is a perforated side 41, and the light emitting diodes 12 are disposed therein and arranged so that they can be seen. The terminals for the diodes 12 project into the space between the outer layer 41 and an inner layer 42 and are thus out of view and like in the hat, do not inconvenience the user. The circuitry carried on the circuit board such as shown at 39 in FIG. 1 is carried within a pendant 43, and thus all of the wiring between such circuitry and the diodes extends through the supporting portion of the pendant into the space between the belt layers. It is intended that the pendant be so provided that it can be disposed out of view. For example, as shown, the pendant can project downwardly into a left trouser pocket. If the structure were inverted, the pendant would be emanating from the upper edge and could be flipped over the upper edge of the garment and into the trousers or skirt of the wearer where no pocket is available.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. A hat assembly comprising, in combination:

(a) a rigid opaque hat having a side exposed to view when worn, and having perforations through said side leading to the space above the head of the wearer;

(b) a series of light emitting diodes of the display type disposed in and projecting through said perforations for being viewed, the terminals thereof being disposed out-of-view;

(c) a battery for powering said diodes; and (d) control circuitry interconnecting said battery and said diode terminals, said circuitry being adapted to energize said diodes sequentially at a rate to optically simulate motion and including (1) an electronic clock adapted to emit electrical pulses, (2) an electronic counter driven by said clock pulses, and (3) a decoder connecting said counter to predetermined ones of said diodes.

2. A hat assembly according to claim 1, including an external variable resistor connected to said clock for manually changing the speed of said clock.

3. A hat assembly according to claim 1, including a pair of gates connecting said clock to separate up-down inputs of said counter, and a flip-flop circuit enabling one of said gates at a time and pulsed by a source of control signals.

4. A hat assembly according to claim 1, including a manual selector connected between said clock and separate up-down inputs of said counter.

5. A hat assembly according to claim 1, including a series of electronic gates in series with selected ones of said diodes, said gates being controlled by the outputs of said decoder.

6. A hat assembly according to claim 5, said electronic gates comprising PNP transistors whose bases are connected to said decoder outputs, whose collectors are grounded, and whose emitters are connected to said selected ones of said diodes.

7. A hat assembly according to claim 1, said battery being of the rechargeable type, a full-wave rectifier bridge circuit connected thereto, a jack connected to said bridge and adapted to be connected to a low-voltage ac-power supply, and a selector switch for (a) closing said bridge circuit while opening said control circuitry, and for (b) opening said bridge circuit while closing said control circuitry.

8. A hat assembly according to claim 3, said source of control signals being two of the outputs of said decoder.

* * * * *